US007784869B2

(12) United States Patent
Mathiesen

(10) Patent No.: US 7,784,869 B2
(45) Date of Patent: Aug. 31, 2010

(54) MOTION SUPPORT APPARATUS

(76) Inventor: John P. Mathiesen, 957 Oakridge Ave., Shoreview, MN (US) 55126

( * ) Notice: Subject to any disclaimer, the term of this patent is extended or adjusted under 35 U.S.C. 154(b) by 524 days.

(21) Appl. No.: 11/522,861

(22) Filed: Sep. 19, 2006

(65) Prior Publication Data

US 2007/0090672 A1 Apr. 26, 2007

Related U.S. Application Data

(60) Provisional application No. 60/728,365, filed on Oct. 19, 2005.

(51) Int. Cl.
*A47C 3/02* (2006.01)
*A63G 13/06* (2006.01)
*A63G 17/00* (2006.01)

(52) U.S. Cl. ..... 297/258.1; 297/313; 472/95; 472/135

(58) Field of Classification Search ..... 297/258.1, 297/313–314; 472/95, 103–105, 135; 482/33
See application file for complete search history.

(56) References Cited

U.S. PATENT DOCUMENTS 2,964,094 A * 12/1960 Gariepy ..... 248/632
2,993,530 A * 7/1961 Little et al. ..... 472/103
3,204,953 A * 9/1965 Ahrens ..... 472/103
3,246,893 A * 4/1966 Dale et al. ..... 482/24
3,268,223 A * 8/1966 Woodsum, Jr. ..... 472/14
3,365,194 A * 1/1968 Strickland, Jr. ..... 482/33
3,578,381 A * 5/1971 Young ..... 297/302.2
3,675,919 A * 7/1972 Ewers ..... 472/113
3,865,682 A * 2/1975 Marzocchi ..... 428/378
4,027,843 A * 6/1977 Thompson ..... 248/632
4,351,521 A * 9/1982 Erdos ..... 472/104
4,516,766 A 5/1985 Sutton, Jr. ..... 272/52
4,728,087 A * 3/1988 Wils ..... 267/178
5,415,590 A 5/1995 Steingraber et al. ..... 473/103
5,569,131 A * 10/1996 Giulianelli ..... 482/77
5,891,003 A * 4/1999 Deac et al. ..... 482/106
6,022,303 A * 2/2000 Abdo ..... 482/140
6,312,366 B1 * 11/2001 Prusick ..... 482/130

FOREIGN PATENT DOCUMENTS

DE 3534456 A1 * 4/1987

* cited by examiner

*Primary Examiner*—David Dunn
*Assistant Examiner*—Tania Abraham
(74) *Attorney, Agent, or Firm*—Jacobson and Johnson; Thomas N. Phung

(57) ABSTRACT

A motion support apparatus comprising an elongated member composed of an elastomeric material and having a pinch-free exterior surface, the elongated member including a first end attached to a support surface and a second end secured to an underside of a user supporting member to provide a range of motion to the user supporting member through the flexing and bending of the elongated member while preventing the presence of potential pinch points thereon.

15 Claims, 5 Drawing Sheets

MOTION SUPPORT APPARATUS

CROSS REFERENCE TO RELATED APPLICATIONS

This application claims priority to currently pending U.S. Provisional Application Ser. No. 60/728,365; filed on Oct. 19, 2005; titled MOTION SUPPORT APPARATUS.

STATEMENT REGARDING FEDERALLY SPONSORED RESEARCH OR DEVELOPMENT

None

REFERENCE TO A MICROFICHE APPENDIX

None

FIELD OF THE INVENTION

This invention relates to supporting apparatus, and more specifically to a motion supporting apparatus that allows users to induce motion to a user supporting member such as a platform supported by the motion supporting apparatus.

BACKGROUND OF THE INVENTION

Various motion supporting devices are known in the art. Traditional rocking chairs for example include the use of an arc-shaped rocker to provide a chair with a back and forth rocking motion. FIG. 1 shows another example of an apparatus comprising a traditional rocking horse supported on a support surface by a coiled spring. The coil spring enables a user to induce a rocking motion while riding on the rocking horse by leaning back and forth in a particular direction. Although the traditional rocking chair and spring supported rocking horse work for their intended purpose, one of the problems associated with motion supporting devices such as the traditional arc-shaped rocker of the rocking chair and the coil spring supported rocking horse is the presence of potential pinch points, such as between the arc-shaped rocker and the support surface for the rocking chair and the voids between the coiled springs of the coil spring supported rocking horse as the coiled spring compresses and expands, which can lead to injuries not only to the user but also to those situated nearby the device.

BRIEF SUMMARY OF THE INVENTION

The present invention comprises a rocking device having a user supporting member and at least one motion support apparatus supporting the user supporting member on a support surface. The motion support apparatus comprises an elongated member composed of an elastomeric material and includes a pinch-free exterior surface. The elongated member includes a first end attached to the support surface and a second end secured to an underside of the user supporting member to provide a range of motion to the user supporting member through the flexing and bending of the elongated member while preventing the presence of potential pinch points thereon. In one embodiment of the rocking device of the present invention, the first end of the elongated member is directly attached to the support surface and the second end of the elongated member is directly secured to the underside of the user supporting member.

Alternatively, the rocking device of the present invention may also include a first mounting bracket secured to the first end of the elongated member for anchoring the motion support apparatus to the support surface through a continuously void-free connection and a second mounting bracket secure to the second end of the elongated member for connecting the user supporting member to the elongated member through a continuously void-free connection for preventing the presence of potential pinch points.

DESCRIPTION OF THE PRIOR ART

U.S. Pat. No. 4,516,766 teaches a base assembly for playground equipments that includes a body of resilient rubber material having an overhanging portion to enhance the rocking motion of the playground equipment.

U.S. Pat. No. 5,415,590 teaches an elastomeric spring device having a dome configuration for use with playground equipment.

DESCRIPTION OF THE PREFERRED EMBODIMENT

Generally, the present invention comprises a motion support apparatus for providing various degrees of motion to members such as playground equipments and seating arrangements including but not limited to chairs and benches while eliminating the presence of pinch point that can lead to injuries. The motion support apparatus comprises an elongated member composed of an elastomeric material and having a pinch-free exterior surface, a first end attached to a support surface and a second end secured to an underside of a user supporting member to provide a range of motion to the user supporting member through the flexing and bending of the elongated member while preventing the presence of potential pinch points that may injury the user or those nearby.

Figure 1:
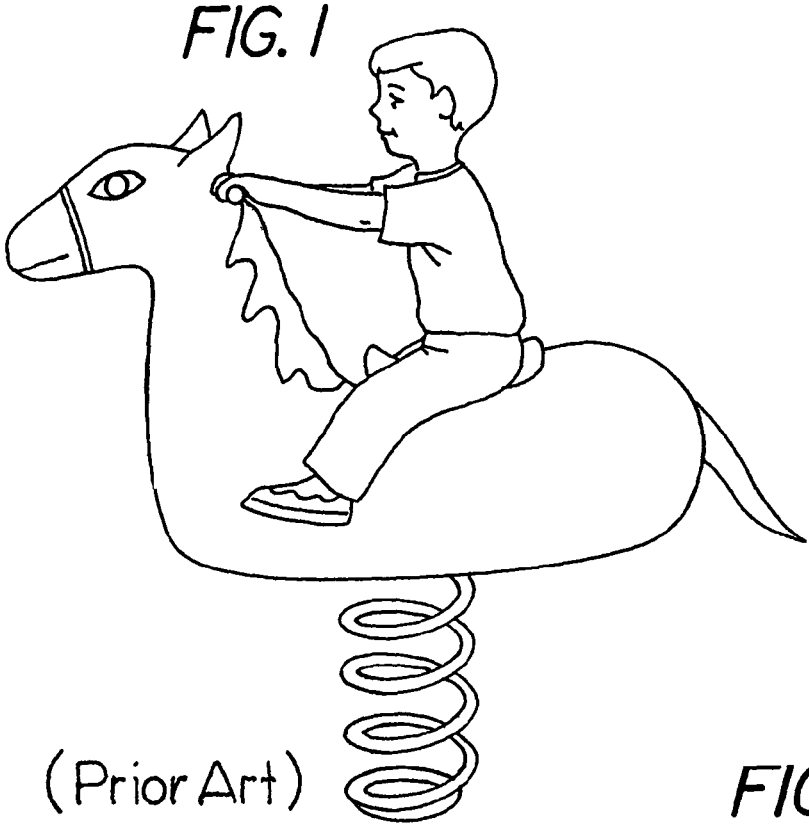
FIG. 1 shows a prior art playground apparatus comprising a traditional rocking horse supported on a support surface by a coiled spring.
Figure 2:
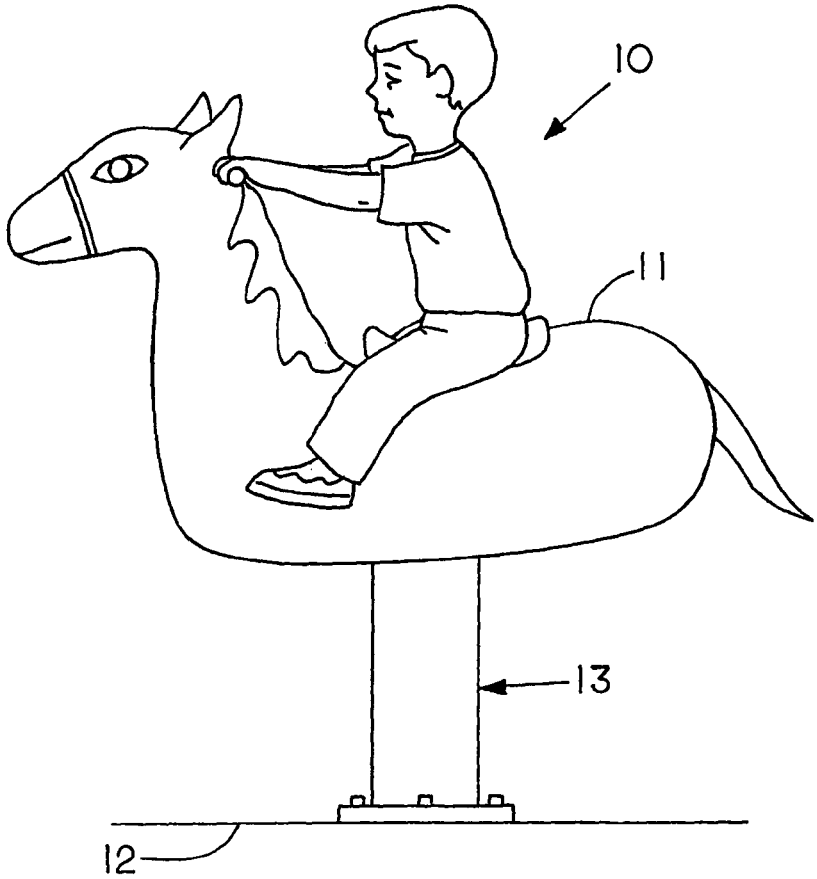
(Prior Art) FIG. 2
FIG. 2 shows a perspective view of a rocking horse supported on a support surface by a motion support apparatus.

Referring to FIG. 2, FIG. 2 shows a rocking horse 10 comprising a seat member 11 supported on a support surface 12 by a motion support apparatus 13 of the present invention. It is noted that the motion support apparatus 13 of the present invention is advantageous in that it provides rocking horse 10 with similar motion as that of the coiled spring shown in FIG. 1 but without the presence of a potential pinch point as previously noted for the coiled spring of FIG. 1.

Figure 3:
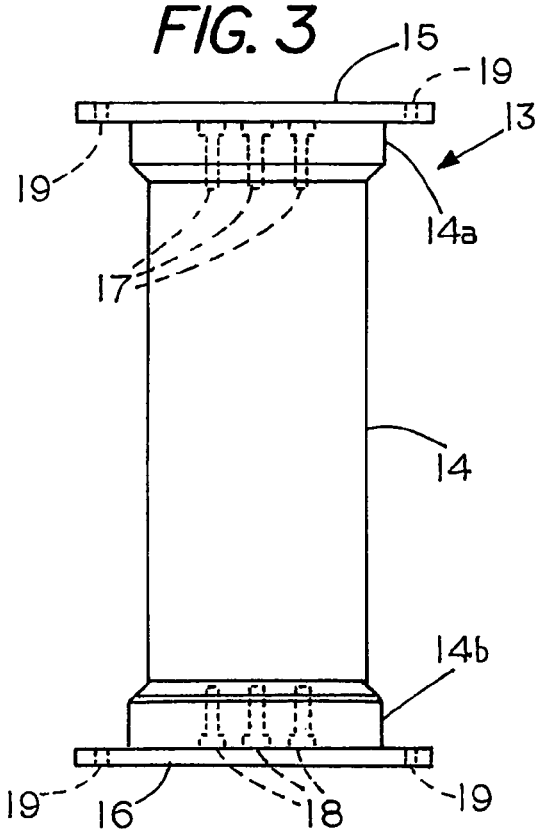
FIG. 3 shows a side view of the motion support apparatus.
Figure 4:
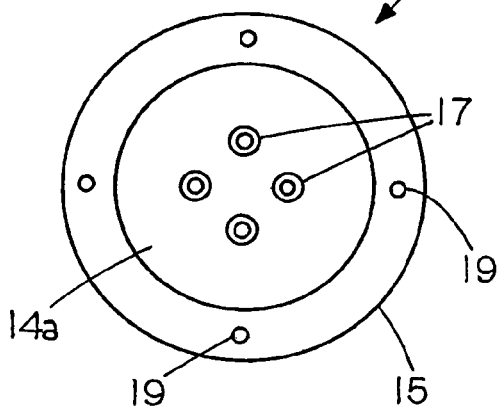
FIG. 4 shows a top view of the motion support apparatus of FIG. 3.

Referring to FIGS. 3 and 4, FIG. 3 shows a side view and FIG. 4 shows a top view of an embodiment of the motion support apparatus 11 of the present invention. As shown in FIG. 3, motion support apparatus 13 includes an elongated, preferably linear-shaped body 14 comprising a high strength resiliently flexible material and with a pinch-free exterior surface. That is, the exterior surface of body 14 comprises a continuously smooth surface not only when motion support apparatus 11 is in a rest condition but also during all stages of use of motion support apparatus 111 during which body 14 bends, flexes, stretches, and/or gyrates thereby preventing the presence of gaps or peaks and valley on the exterior, which can lead to potential pinch point(s) thereon.

Body 14 of the motion support apparatus 13 is shown as comprising an elongate cylindrical shaped having a flared first end 14*a* and a flared second end 14*b*. It is noted that alternative embodiments of the present invention can include motion support apparatuses having bodies comprising a variety of sizes and shapes including but not limited to a cone shape, a triangular shape, a square shape, a rectangle shape, and an octagonal shape with or without flared ends.

Motion support apparatus 13, as shown in FIG. 3, includes a first support bracket 16 secured to the first end 14*b* of the elongate cylindrical shaped body 14 by a first set of bolts 18 and a second support bracket 15 secured to the second end 14*a* of the elongate cylindrical shaped body 14 by a second set of bolts 17. Although the brackets 15 and 16 can be secured to the body 14 of motion support apparatus 13 after the body 14 of motion support apparatus 13 is formed, brackets 15 and 16 are preferably secured to the body 14 of motion support apparatus 15 during the molding stages of motion support apparatus 13.

A feature of the present invention is that brackets 15 and 16 are secured to the ends 14*a* and 14*b* of the elongate cylindrical shaped body 14 in a condition to provide for a void-free connection between the brackets 15 and 16 and the connecting ends 14*a* and 14*b* of the elongate cylindrical shaped body 14 to prevent voids regions thereabout thereby eliminating potential pinch points around the aforementioned regions during allow stages of use of motion support apparatus 13.

While the embodiment of FIGS. 3 and 4 show brackets 15 and 16 secured to ends 14*a* and 14*b* of elongate cylindrical shaped body 14 through the use of set of bolts 17 and 18, brackets 15 and 16 may be secured to the ends 14*a* and 14*b* of elongate cylindrical shaped body 14 by a variety of methods including but not limited to being glued to, extruded to, or molded to the ends 14*a* and 14*b* of elongate cylindrical shaped body 14.

Support brackets 15 and 16 each also includes a set of orifices 19, preferably positioned equal distance thereon, for securing an end of the motion support apparatus 13 to an underside of a user support member and an opposing end of the motion support apparatus 13 to a support surface. A feature of body 14 is that body 14 comprises a sufficient length to permit it to flex, bend, and/or gyrate under the reaction of the user.

While the embodiment of FIGS. 3 and 4 show the use of brackets 15 and 16 for securing motion support apparatus 13 between the user support member and the support surface, alternative embodiments can comprise a first end of an elongated member of a motion support apparatus directly attached to a support surface and a second end of the elongated member of the elongated member directly secured to the underside of the user supporting member to provide motion to the user supporting member through the flexing and bending of the elongated member while preventing the presence of potential pinch points.

Referring to the high strength resiliently flexible material of the body 14 of the motion support apparatus 13, it is noted that the high strength resiliently flexible material can comprise a variety of materials capable of flexing and bending yet is sufficiently durable to prevent breakage or tearing while being weather resistant and cut resistant. An example of a suitable material include Andur® 90-AP and Andur® 95-AP which are elastomers comprising a polymer (PTMG) based liquid, toluene diisocyanate terminated prepolymer produced and sold by Anderson Development Company, a company located in Adrian, Mich.

Another example of a suitable material include polyurethane elastomers and microcellular polyurethane elastomers having the following range of physical properties and characteristics: tensile strength of 10 to 65 Mpa, shore hardness of 50 A to 85 D, elongation of 100-800%, flexural modulus of 2 to 104 Mpa, glass transitional temperature of −80 degree to 50 degree C., abrasion resistance, low-temperature flexibility, low temperature impact strength, long-term flexibility, tear/cut resistance, good elasticity and rebound, ozone resistance, weather resistance and temperature resistance. The aforementioned properties are defined and can be characterized in accordance with applicable ASTM standards.

Figure 5:
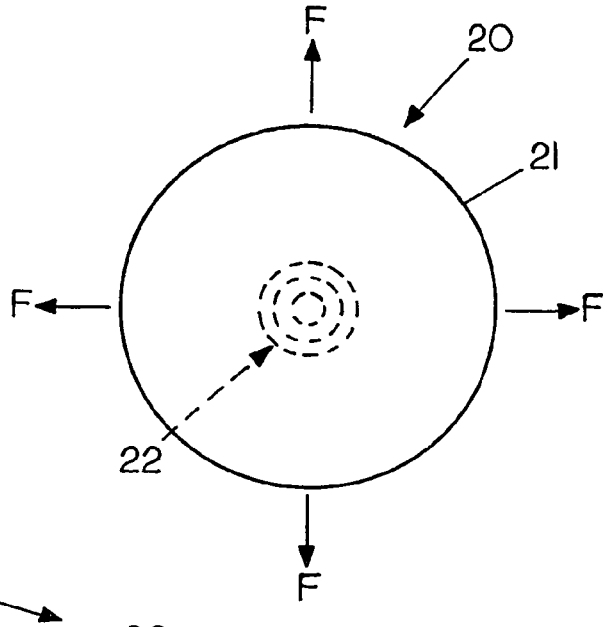
FIG. 5 shows a top view of a rocking playground device comprising a circular shaped platform supported by a motion support apparatus at the center of the platform.

FIG. 5 shows a top view of a rocking playground device 20 having a circular shaped platform 21 supported by a single motion support apparatus 22 at the center of the circular shaped platform 21. A feature of rocking playground device 20 is that since the body of motion support apparatus 22 comprises a linear-shaped, the central support of the circular shaped platform 21 by the motion support apparatus 22 enables the user to induce a 360 degrees lateral movement through the bending and flexing of the motion support apparatus 22 with the same amount of force F in all directions while on the circular shaped platform 21. That is, since motion support apparatus 22 comprises a circular, linear shaped body and centrally supports circular shaped platform 21 on the support surface, the rocking playground device 20 does not have a preference in the direction that the device 20 will rock towards.

Although not shown, the motion preference of device 20 can be altered by moving the support of motion support apparatus 22 to various off-centered positions or by replacing motion support apparatus 22 with a motion support apparatus having a non-linear shaped body.

Figure 6:
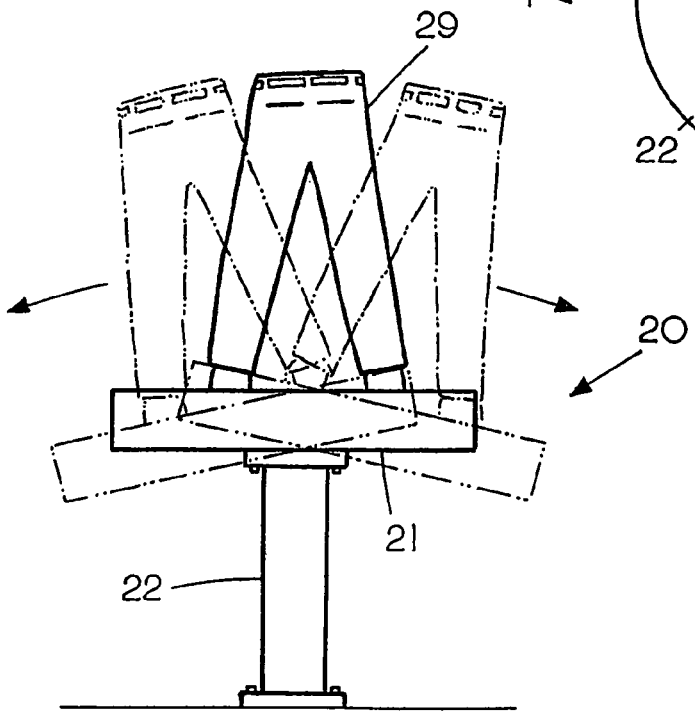
FIG. 6 shows a side view of the rocking playground device of FIG. 5 in use.

FIG. 6 shows a side view of the rocking playground device 20 of FIG. 5 in use. In use, a user 29 first gets on platform 21 and leans back and forth in a particular direction to induce movement of the rocking playground device 20. Although FIG. 6 shows the user 29 standing on platform 21 while inducing motion of the device 20, the user 29 alternatively can also induce motion of the device 20 while sitting or laying on the platform 21.

Figure 7:
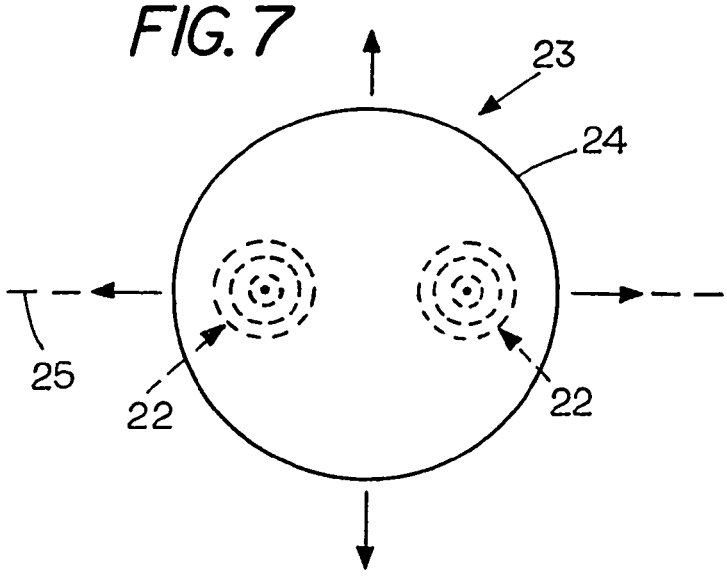
FIG. 7 shows a top view of a rocking playground device comprising a circular shaped platform supported by a pair of motion support apparatuses.

FIG. 7 is also a top view of a rocking playground device 23 comprising a circular-shaped platform 24 supported by two motion support apparatus 22 each having a pinch-free exterior surface. The two motion support apparatus 22 are shown supporting the circular platform 24 at an off-centered position. Unlike the rocking playground device 20 of FIG. 5, the off-centered support of the circular shaped platform 24 by the two motion support apparatuses 22 results in a preference of the rocking playground device 23 to move or rock in directions perpendicular to an axis 25 extending through the center of both of the support apparatuses 22. That is, the rocking playground device 23 will require a greater amount of force by the user to move or rock the playground device 23 in a direction running parallel with the axis 25 than to move or rock the playground device 23 in the direction running perpendicular to the axis 25.

Figure 8:
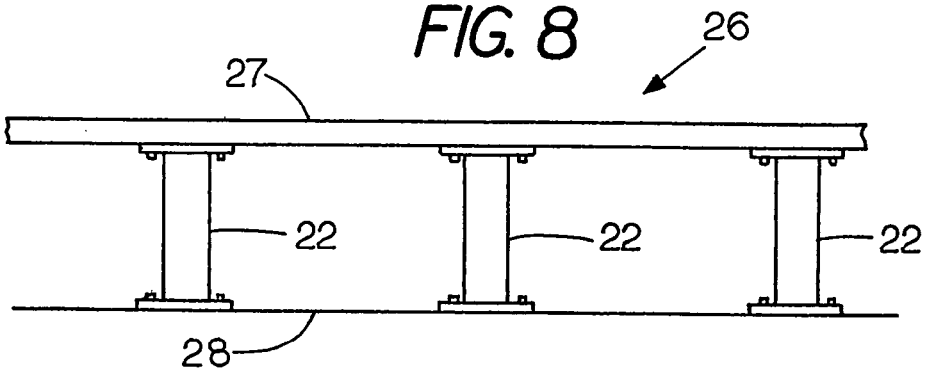
FIG. 8 shows a rocking playground device comprising a balance beam having a plurality of motion support apparatus supporting the plank thereon in a linear fashion.

FIG. 8 shows an alternative rocking playground device 26 of the present invention comprising a plank 27 having a plurality of motion support apparatuses 22 supporting the plank 27 on a support surface 28 in a linear fashion. Similar to the rocking playground device 23 of FIG. 6, since the plurality of motion support apparatuses 22 are positioned in a linear fashion in supporting plank 27, rocking playground device 26 will have a preference to move or rock in directions perpendicular to the plank 27.

Figure 9:
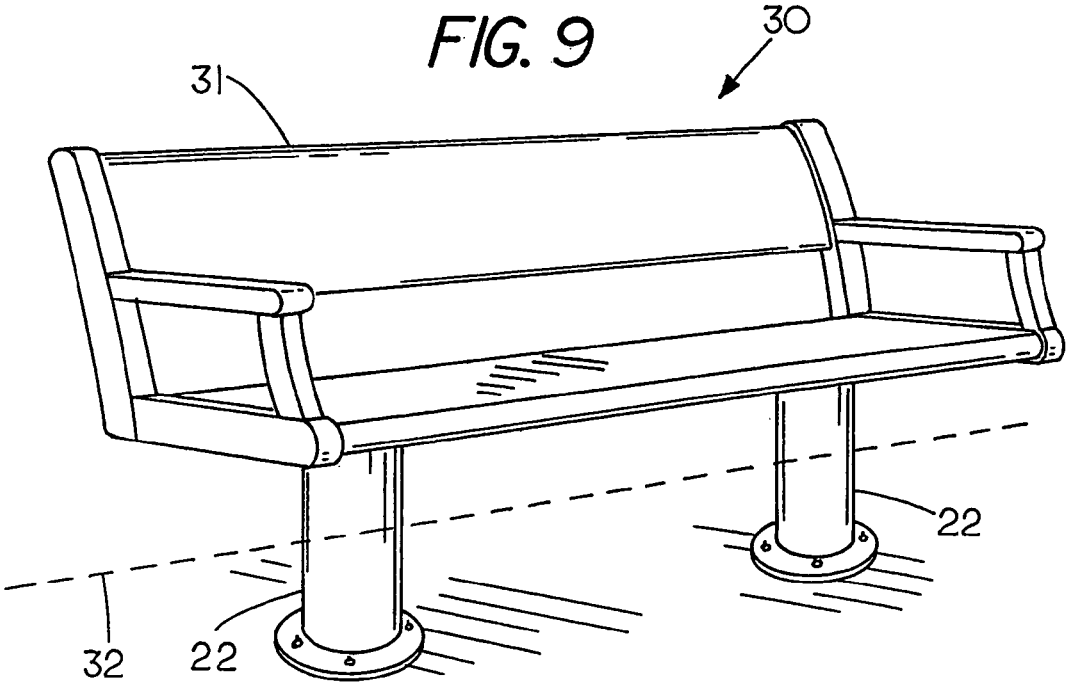
FIG. 9 shows a perspective view of a rocking device comprising a bench supported by a pair of motion support apparatuses.
Figure 10:
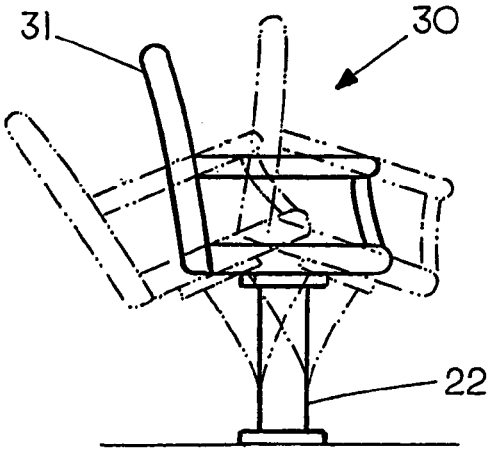
FIG. 10 shows a side view of the rocking device of FIG. 9.

Referring to FIGS. 9 and 10, FIG. 9 shows a perspective view and FIG. 10 shows a side view of a rocking device 30 of the present invention comprising a bench 31 supported by a pair motion support apparatuses 22 each having a pinch-free exterior surface. It is noted that the pair motion support apparatuses 22 are purposely positioned, in supporting the bench 31, in a direction running parallel to the length of bench 31 so as to provide a preference of rocking playground device 30 to move or rock in a direction running perpendicular to an axis 32 extending through the center of the first and second support apparatus as shown in FIG. 10.

Figure 11:
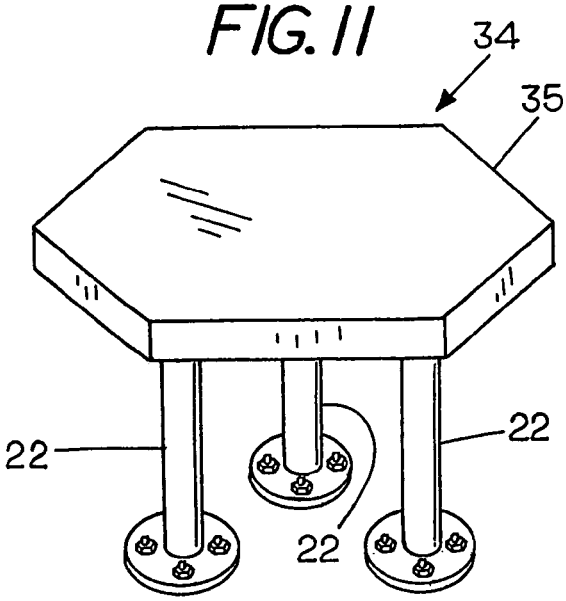
FIG. 11 shows a perspective view of a rocking playground device comprising a hexagon shaped platform supported by three motion support apparatus.
Figure 12:
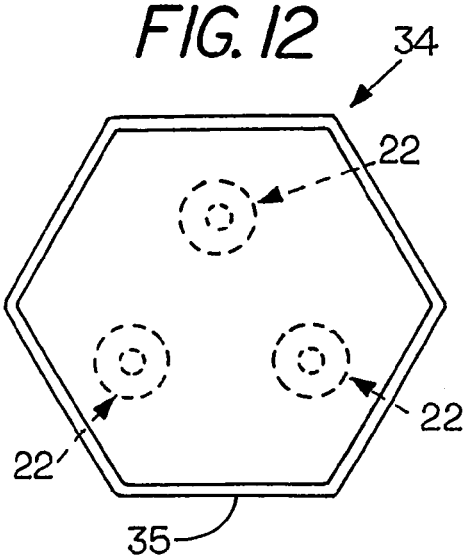
FIG. 12 shows a top view of the rocking playground device of FIG. 11.

FIG. 11 shows a perspective view and FIG. 12 shows a top view of a rocking playground device 34 comprising a hexagon shaped platform 35 supported by three motion support apparatus 22. In regards to platform 35, platform 35 can comprise a plurality of materials including but not limited to wood, plastic, fiberglass, or metal. If platform 35 comprises a corrodible material, in order to extend the life of platform 35, platform 35 preferably also is coated with a weatherproof material. In regards to the weatherproof material coating, the weatherproof material coating can comprise but is not limited to a plastic coating, a rubberized coat and a vinyl or vinyl-like material to extend the life of the elongated planks such as by reducing rust and corrosion. An example of the aforementioned material comprises a poly vinyl chloride coating. In order to enhance the aesthetic appearance of the rocking playground device 34, motion support apparatus 22 can be manufactured to color-match the color of hexagon shaped platform 35.

The three motion support apparatuses 22 are shown supporting the hexagon shaped platform 35 equal distance from the center of the platform 34. The positioning of the three motion support apparatuses 22 enables the user to induce a range of rocking motion similar to the rocking playground device of FIG. 5 but more limited. That is, the rocking playground device 34 of FIG. 11 has a limited preference in the direction that the device will rock towards compared to the devices of FIGS. 7, 8, and 9.

It is noted again that a feature of the motion support apparatus of the present invention is that the motion support apparatus is capable of flexing and bending to provide motion to the member that the motion support apparatus supports, with the motion similar to the motion associated with of the use of the coiled springs while eliminating potential pinch points associated with of the use of the coiled springs.

In regards to the range of movement of the rocking device of the present invention, the range of movement of the rocking playground device of the present invention will vary depending on a number of factors, including the position of the motion support apparatus with respect that the member supported thereon, the length of the body of the motion support apparatus supporting, the number of the motion support apparatus used, the density of the body of the motion support apparatus (including whether the interior of the motion support apparatus is hollow), the diameter of the motion support apparatus, and the shape of the motion support apparatus.

For example, the range of motion for a rocking device of the present invention can be changed or tailored by varying the length of the body of the motion support apparatus while leaving the circumference or width of the body of the motion support apparatus unchanged. That is, a first rocking device having a motion support apparatus with a body having the same circumference but a longer length than the length of a body of a motion support apparatus of a second rocking device will provide for a greater range of motion than the second rocking device. It is noted that as the length of the body of the motion support apparatus increases while the circumference is unchanged, the range of motion of the rocking device will likewise increase.

Figure 13:
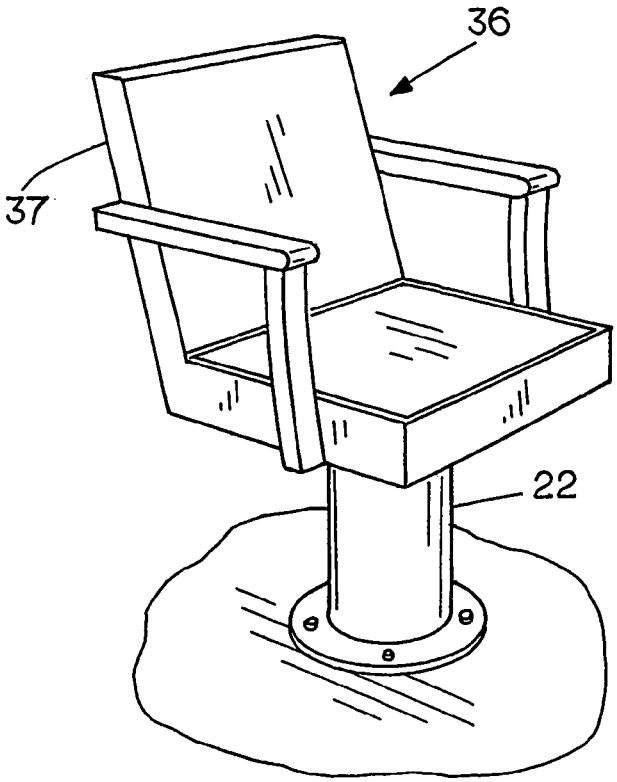
FIG. 13 shows a perspective a rocking device comprising a chair supported by the motion support apparatus of FIG. 3.

FIG. 13 shows a perspective a rocking device 36 of the present invention comprising a chair 37 supported by motion support apparatus 22 thereon. It is noted that motion support apparatuses 22 is being used in the embodiment of FIG. 13 as a replacement of a traditional rocker of a traditional rocking chair to provide chair 37 not only a back and forth rocking motion similar to that of the traditional rocking chair but also a side-to-side motion while preventing the presence of potential pinch points typical of the traditional rocker base rocking chairs, namely preventing the presence of potential pinch points located between the rocker of the traditional rocking chair and the support surface.

Figure 14:
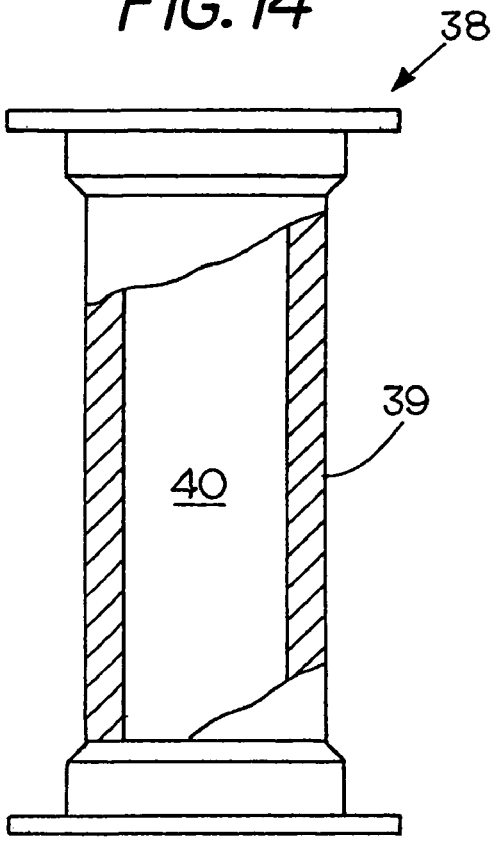
FIG. 14 shows a partial cross-sectional side view of a motion support apparatus that includes a body having a hollow interior.

FIG. 14 shows a partial cross-sectional side view of an alternative embodiment of a motion support apparatus 38 similar to the motion support apparatus 13 of FIG. 3. However, unlike motion support apparatus 13, motion support apparatus 38 includes a body 39 having a hollow interior 40. It is noted that the presence of hollow interior 40 results in motion support apparatus 38 providing for a different range of motion compared to motion support apparatus 13.

Figure 15:
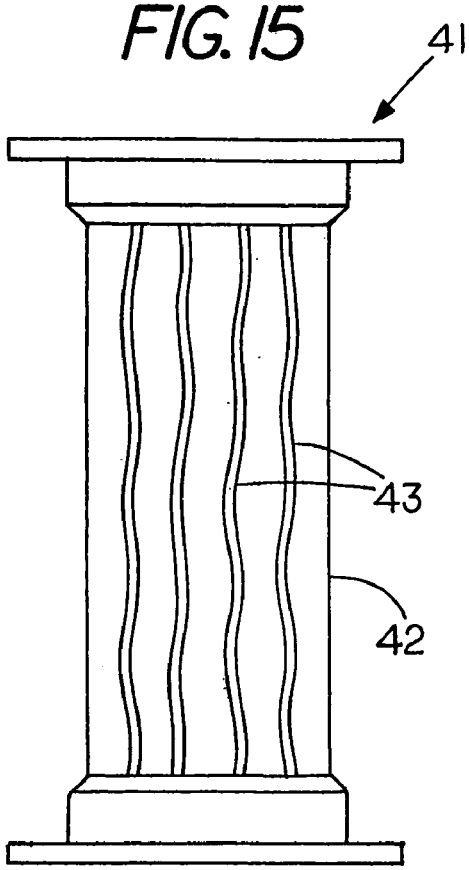
FIG. 15 shows a side view of a motion support apparatus having a body that is embedded with a plurality of cut resistant wires therein.

FIG. 15 shows a side view of an alternative embodiment of a motion support apparatus 41 similar to the motion support apparatus 13 of FIG. 3. However, motion support apparatus 41 includes a body 42 having a plurality of cut resistant wires 43 or the like embedded therein. The presence of metal wire 43 located within body 42 functions to deter vandalism by preventing vandals from completely slicing through body 42, such as with a knife, to damage motion support apparatus 41. It is noted that other materials can be implanted in the body 42 of motion support apparatus 41 to prevent vandalism so long as the implanted material is resistant to being cut while still allowing the motion support apparatus 41 to flex and bend.

Figure 16:
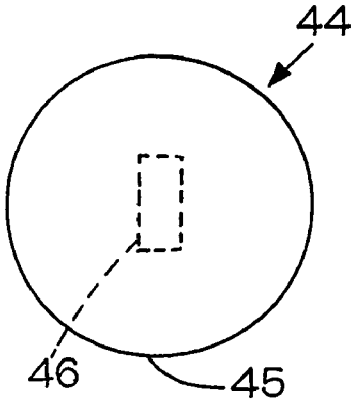
FIG. 16 shows a top view of a rocking playground device comprising a circular-shaped platform supported by a rectangular-shaped motion support apparatus.
Figure 17:
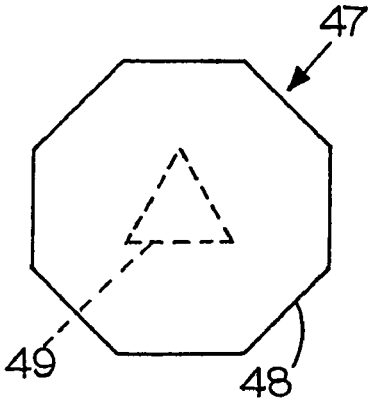
FIG. 17 shows a top view of a rocking playground device comprising an octagonal-shaped platform supported by a triangular-shaped motion support apparatus.
Figure 18:
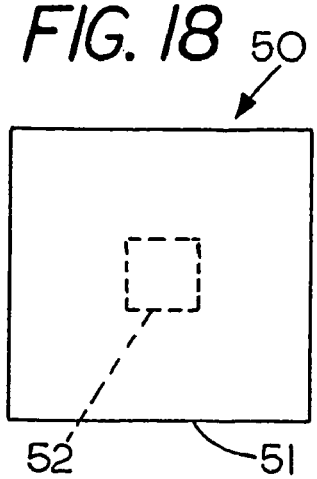
FIG. 18 shows a top view of a rocking playground device comprising a square-shaped platform supported by a square-shaped motion support apparatus.

It is noted that alternative embodiments of the present invention can include motion support apparatuses having bodies comprising a variety of shapes. For example, referring to FIGS. 16, 17, and 18, FIG. 16 shows a top view of a rocking playground device 44 comprising a circular-shaped platform 45 supported by a rectangular-shaped motion support apparatus 46. FIG. 17 shows a top view of a rocking playground device 47 comprising an octagonal-shaped platform 48 supported by a triangular-shaped motion support apparatus 49. FIG. 18 shows a top view of a rocking playground device 50 comprising a square-shaped platform 51 supported by a square-shaped motion support apparatus 52.

I claim:

1. A motion support apparatus comprising:

an elongated member composed of an elastomeric material and having a pinch-free exterior surface, the elongated member including a first flared end attached to a support surface and a second flared end;

a first mounting bracket bolted to said first flared end of said elongated member;

a second mounting bracket bolted to said second flared end of the elongated member; and a user support member having an underside, said underside of said user support member bolted to said second mounting bracket to provide a range of motion to the user supporting member solely through the flexing and bending of the elongated member while preventing the presence of potential pinch points thereon.

2. The motion support apparatus of claim 1 wherein the elongated member is triangular, circular, rectangular or square shaped.

3. The motion support apparatus of claim 1 wherein the elongated member comprises a linear-shaped elongated member.

4. The motion support apparatus of claim 1 wherein the user supporting member is coated with a weatherproof material to extend the life of the user supporting member.

5. The motion support apparatus of claim 1 wherein the user supporting member comprises a platform.

6. The motion support apparatus of claim 1 wherein the user supporting member comprises a bench.

7. The motion support apparatus of claim 1 wherein the user supporting member comprises a chair.

8. The motion support apparatus of claim 1 wherein the elongated member includes a hollow interior.

9. The motion support apparatus of claim 1 wherein the elongated member includes a cut resistance material implanted therein.

10. A rocking device comprising:

a user supporting member; and at least one motion support apparatus comprising an elongated member composed of an elastomeric material and having a pinch-free exterior surface, the elongated member including a first flared end and a second end flared end;

a first mounting bracket bolted to the first flared end of the elongated member, said first mounting bracket anchoring the at least one motion support apparatus to a support surface through a continuously void-free connection; and a second mounting bracket bolted to the second flared end of the elongated member and bolted to the underside of the user supporting member, said second mounting bracket securing and rotationally restraining the user supporting member to the at least one motion support apparatus through a fixed continuously void-free connection to provide a range of motion to the user supporting member through the flexing and bending of the motion support apparatus while preventing the presence of potential pinch points.

11. The rocking device of claim 10 wherein the exterior surface of the elongated member is free of protrusions.

12. The rocking device of claim 10 wherein the elongated member comprises a triangular, circular, rectangular or square shaped cross-section.

13. The rocking device of claim 10 wherein the elongated member includes a cut resistance material implanted therein.

14. The rocking device of claim 10 wherein the elastomeric material comprises a polymer (PTMG) based liquid, toluene diisocyanate terminated prepolymer.

15. A rocking device comprising:

a user supporting member;

at least one motion support apparatus comprising a linear elongated member composed of a polymer (PTMG) based liquid, toluene diisocyanate terminated prepolymer and having a pinch-free exterior surface, the linear elongated member having a first flared end and a second flared end;

a first mounting bracket bolted to the first flared end of the linear elongated member for anchoring the at least one motion support apparatus to a support surface through a continuously void-free connection; and a second mounting bracket bolted to the second flared end of the linear elongated member and bolted to an underside of a user supporting member, said second mounting bracket securing and rotationally restraining the user supporting member to the at least one motion support apparatus through a continuously void-free connection to provide a range of motion to the user supporting member through the flexing and bending of the motion support apparatus while preventing the presence of potential pinch points.

* * * * *